US005415417A

United States Patent [19]

Reis, Jr.

[11] Patent Number: 5,415,417

[45] Date of Patent: May 16, 1995

[54] ROBOTIC AMUSEMENT GAMING MACHINE

[76] Inventor: Robert M. Reis, Jr., 15905 Bent Tree Forest Cir., Apt. No. 10006, Dallas, Tex. 27548

[21] Appl. No.: 176,103

[22] Filed: Dec. 30, 1993

[51] Int. Cl.[6] ..... A63F 9/00

[52] U.S. Cl. ..... 273/447; 446/425

[58] Field of Search ..... 273/447, 448; 446/424, 446/425, 426

[56] References Cited

U.S. PATENT DOCUMENTS 4,718,667 1/1988 Shoemaker, Jr. ..... 273/448

4,961,716 10/1990 Hippely et al. ..... 446/426 X

*Primary Examiner*—William H. Grieb

*Attorney, Agent, or Firm*—Richards, Medlock & Andrews

[57] ABSTRACT

An amusement machine having a robotic arm and a grabber mechanism controlled with a pair of joy sticks by a player to select a prize. The robotic arm and the grabber mechanism are accurately controlled by movement of the joy sticks, thereby requiring skill and/or coordination by the player to successfully obtain a prize.

20 Claims, 3 Drawing Sheets

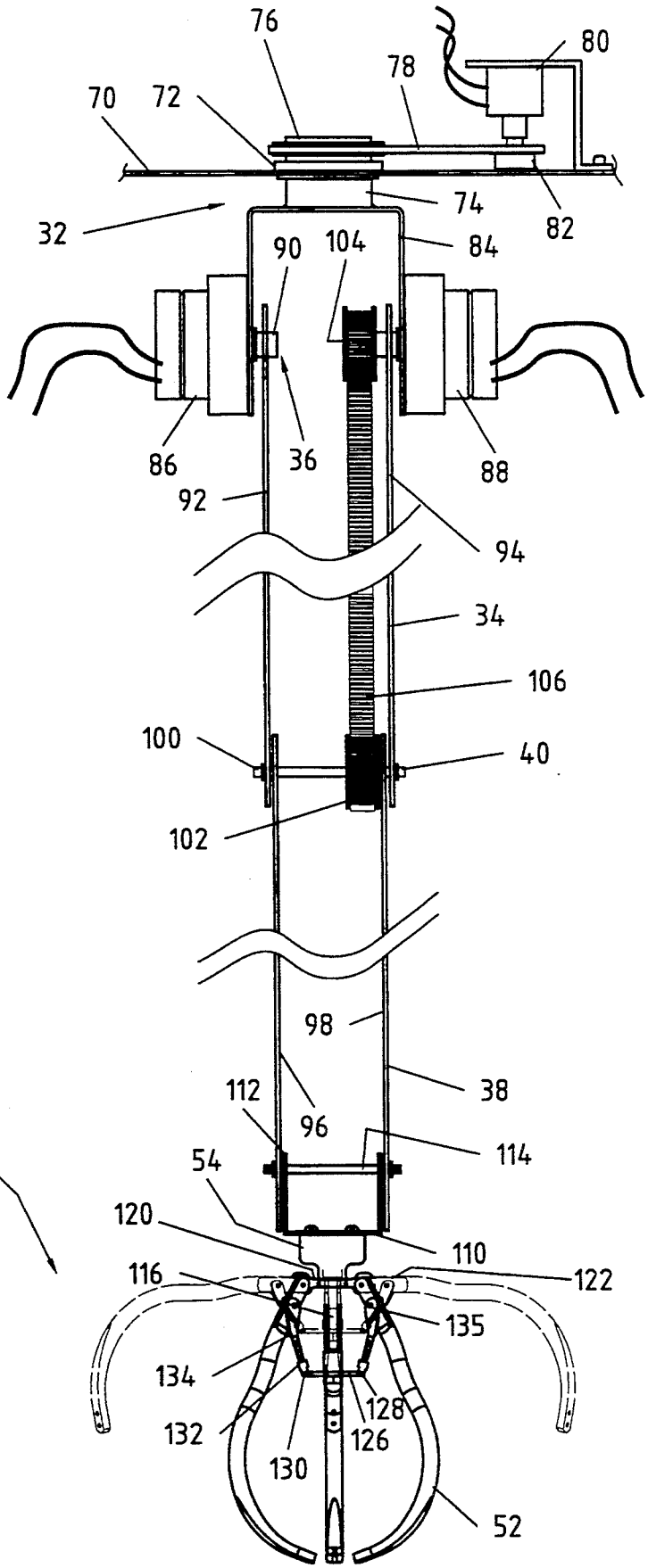
FIG. 2
FIG. 3
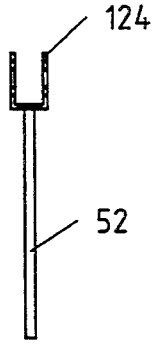

18
22
166
20
162
L
R
168
160
164
COIN DEPOSIT
JOYSTICK MULTIPLEXER
24
170
26
146
140
144
TIME DISPLAY LATCH
RAM
μ P
DATA
ROM
142
172
174
148
154
AUDIO LATCH
AUDIO TRANSDUCER
156
COUNTER TIMER
CONTROL SIGNAL DECODER
180
80
190
+V
196
188
STEPPER MOTOR #1
192
194
PULSER
MOTOR 1 CONTROL
+V
182
198
MULTIPLEXER
186
184
+V
MOTOR AND DIRECTION LATCH
PULSER
MOTOR 5 CONTROL
STEPPER MOTOR #5
+V

ROBOTIC AMUSEMENT GAMING MACHINE

TECHNICAL FIELD OF THE INVENTION

The present invention relates in general to gaming and amusement devices, and more particularly to a coin-operated gaming machine that utilizes a robotic arm that can vend prizes or objects, depending upon the skill and coordination of the operator.

BACKGROUND OF THE INVENTION

The gaming, amusement and vending industry has undergone substantial changes to incorporate electrical and mechanical technological advancements into the products. These advancements are all toward an aim of achieving increased participation of players in an attempt to increase or maintain revenues.

In one field of the amusement industry, coin, token or money operated machines are available to test the skill or coordination of the player and provide a corresponding reward. In one type of amusement machine commonly used, an operator manipulates manual controls to move a crane to grab a prize, and then deliver the prize to the player. While such type of amusement machines were highly successful at one time, they are now overshadowed by the newer video gaming machines which require skill and coordination, but where the reward is not a physical object. In the crane type of amusement machines noted above, a simple gantry design robot provides the player with the prize delivery, but such mechanism is bulky, prone to breakage and often provided limited reliability. Further, the minimal skill and/or coordination required is no longer a challenge to players, as compared to the other video and other types of higher technology games.

It can be seen from the foregoing, that there is a need for a new type of gaming machine where a higher level of skill and/or coordination is required in order to deliver a physical prize to the participant. A further need exists for a mechanism movable according to numerous degrees of freedom, so that the success of obtaining a physical prize is more dependent upon the skill and coordination of the user, rather than by chance. A further need exists for a new type of gaming machine that can readily compete, in terms of user participation, with other well-known video arcade games.

SUMMARY OF THE INVENTION

In accordance with the preferred embodiment of the invention, an amusement machine incorporates a reticulated robotic arm that is movable in multiple directions under control by a player. The robotic arm is disposed in an enclosure with prizes or objects. The machine is coin or money-operated and when activated, the player preferably has a predefined amount of time to manipulate the controls and attempt to move the reticulated robotic arm, and a grabber mechanism attached to the end thereof, in an attempt to seize an object and deliver it through an opening to the player. Preferably, the robotic arm is structured so that it can be controlled by the player for rotation about a vertical axis, and can be controlled as well for pivotal articulating movement about two nonvertical axes. In order to require of the player an enhanced degree of skill, the robotic arm is accurately moved in very small increments, depending on the movements of manual controls by the player.

In accordance with another feature of the invention, a grabber is attached to the end of the robotic arm and can be precisely moved to any position between a fully open and a fully closed position, under control of the player. A significant feature of the invention is that the fingers of the grabber are incrementally moved by a linear actuator, thereby providing precise control by the operator of the grabber.

In yet another feature of the invention, a pair of joy sticks are provided for controlling the movements of the robotic arm, as well as the degree of opening or closing of the grabber fingers. In particular, movement in one direction of one joy stick provides rotational movement of the robotic arm, and movement of the joy stick in a second direction provides articulating movement of the robotic arm along one horizontal axis. Movement in one direction of a second joy stick controls movement of the articulating arm about a second horizontal axis, while movement of the joy stick in a second direction controls the movement of the grabber fingers. Because the joy sticks provide numerous degrees of movement of the robotic arm and the grabber fingers, there is required a corresponding higher degree of skill and coordination by the user in achieving success and obtaining a physical prize.

In accordance with yet another feature of the invention, the amusement machine includes a trap door which must be first opened by the robotic arm, in order for the user to grab and deliver a prize therethrough.

The amusement machine of the invention includes processor-controlled circuits for responding to the joy stick movements and causing corresponding actuators to rotate or pivot the articulated robotic arm, as well as actuate the linear actuator of the grabber. The processor can be programmed to operate in a display mode after a period of inactivity, to automatically move the robotic arm and actuate the grabber to attract players thereto. The processor can also be programmed to operate in another mode in which coins deposited therein activate the machine for a specified period of time, or in another mode where the machine operates until the player is successful in obtaining a prize. The processor can additionally be programmed to maintain an account of the number of attempts and failures of players in achieving success, and automatically adjust the time of play based thereon. In other words, if it is determined that the success rate exceeds a predetermined threshold, then the time of play is automatically reduced.

BRIEF DESCRIPTION OF THE DRAWINGS

Further features and advantages of the present invention will become apparent from the following and more particular description of the preferred embodiment as illustrated in the accompanying drawings, and in which like reference characters generally refer to the same parts or elements throughout the views, and in which:

FIG. 2 is a partial sectional view of the robotic arm and grabber fingers;

FIG. 3 is a side view of grabber finger according to the invention; and

DETAILED DESCRIPTION OF THE INVENTION

Figure 1:
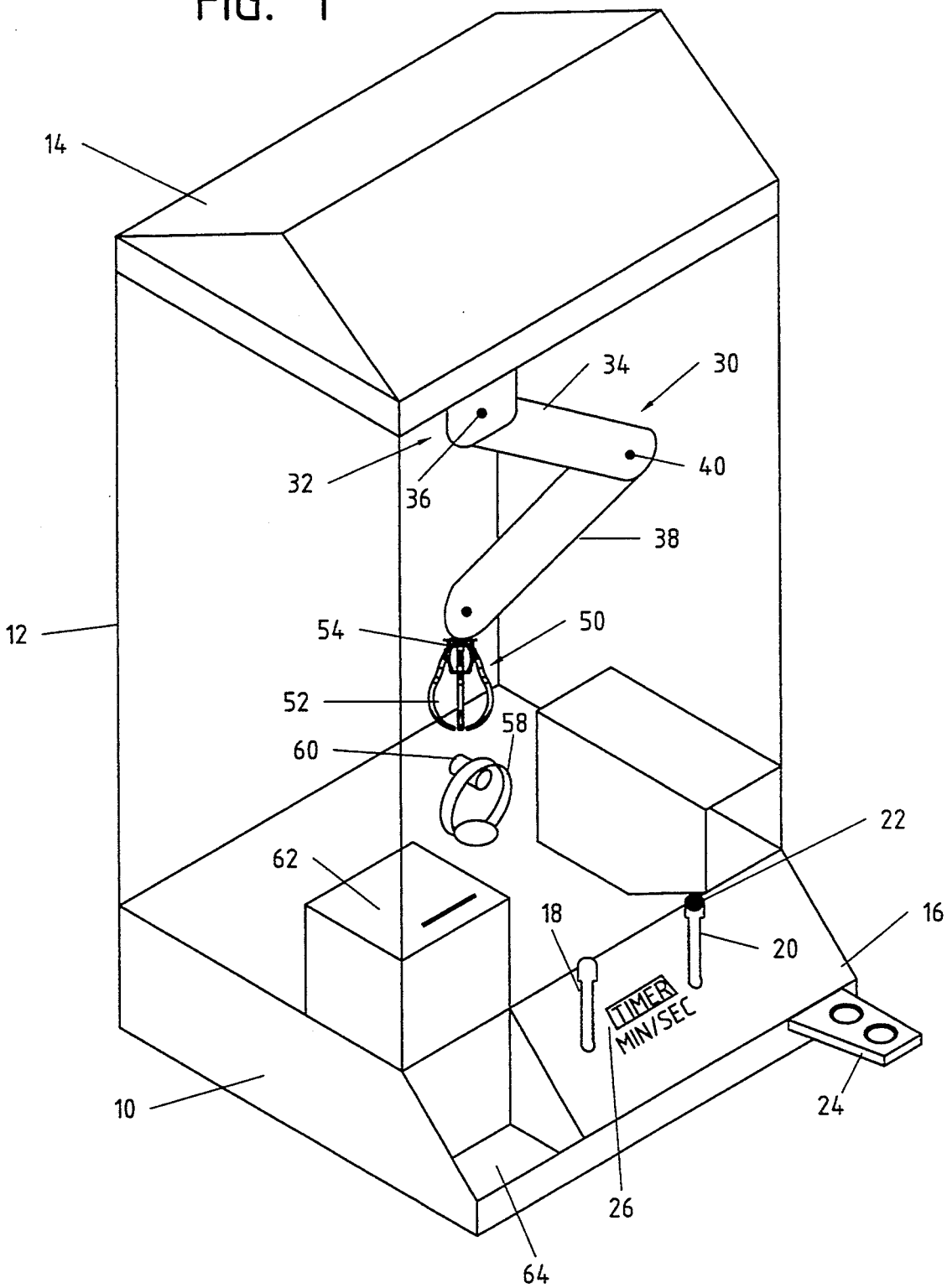
FIG. 1 is an oblique view of the amusement machine according to the invention.

With reference to FIG. 1, there is shown the amusement machine according to the preferred embodiment of the invention. The machine includes a base 10 for supporting a transparent enclosure 12, and a secure cover 14 for covering the top of the enclosure 12. The base 10 has a panel 16 in which there is mounted a first joy stick 18 and a second joy stick 20. The second joy stick 20 includes a thumb-operated button 22 to enable the player to activate the machine. Further, a coin or money deposit apparatus 24 is mounted to the panel 16 for allowing a player to deposit the requisite amount of money into the machine. Of course, printed instructions and other matter are formed on the panel 16 to provide a player with instructions on how to operate the amusement machine. A digital timer 26 is provided on the panel 16 for indicating an elapsed time of play. For example, the amusement machine may be programmed to provide a player with two minutes per dollar, so that if the operator deposits $2.00 in the deposit mechanism 24, four minutes will be displayed on the timer 26. Once the operator pushes the start button 22, the machine is activated and the timer 26 begins to down count toward zero time, whereupon the mechanism is automatically turned off. In another mode of operation, a predefined amount of money can be deposited and the amusement machine continues to operate until the player has successfully obtained a prize.

The manipulation of the joy sticks 18 and 20 are sensed by processor-controlled circuits mounted within the base 10. As will be discussed in more detail below, the processor-controlled circuits are operative to control a robotic arm 30 that is mounted for movement to the underside of the cover 14. The enclosure 12 is preferably formed of a transparent plastic or other type of secure sidewall for allowing the player to observe the movements of the robotic arm 30 corresponding to the movements of the joy sticks 18 and 20. While not shown, electrical signal and power cables are connected between the processor-controlled circuits in the base 10, through a corner conduit to the cover 14, and thus to the actuators of the robotic arm 30. The robotic arm 30 includes a swivel base 32 that is rotatable about a vertical axis. The robotic arm 30 further includes a first arm 34 that is articulated about a horizontal pivot 36, and a second arm 38 that is articulated about a second horizontal pivot 40. The rotational as well as the pivotal movements of the robotic arm 30 are controlled by movements of the joy sticks 18 and 20.

A grabber 50 is hingably connected to the second arm 38 of the robotic arm 30. According to the preferred embodiment of the invention, the grabber 50 includes three curved fingers 52 that are moved by a linear actuator 54. The grabber 50 is hingably mounted to the end of the second arm 38, and thus remains in the position shown as a result of gravitational forces. Those skilled in the art may find that the grabber 50 can be advantageously mounted to the second arm 38 for achieving angular positions, as controlled by the player.

For purposes of example, a prize, such as a watch 58 slipped over a peg 60 is available within the enclosure 12. After a player deposits money in the deposit mechanism 24, and activates the machine by pushing the button 22, the joy stick controls 18 and 20 are skillfully manipulated to control the articulating robotic arm 30 so that the grabber 50 can be opened to grab the prize 50. However, and in accordance with another feature of the invention, a lid or door 62 must first be opened by the grabber 50 of the robotic arm 30, and thereafter the prize 58 delivered therethrough. The prize 58 then slides down a chute (not shown) and is available to the player on the tray 64. Also not shown, a detector in the chute can detect the delivery of the prize 58, thereby automatically closing the door 62 by a solenoid mechanism. The amusement machine of the invention need not incorporate the trap door 62, but rather can leave the chute open, thereby requiring less skill from the operator.

With reference now to FIG. 2, there are illustrated the details of the robotic arm 30, as well as the grabber 50. The robotic arm 30 is mounted for rotational movement to a support plate 70 forming a part of the cover 14 of FIG. 1. The rotational movement is achieved by way of a bearing 72 journaled to a tube 74. A pulley 76 is fastened to the tube 74, and when rotated by a belt 78, the tube 74 and thus the robotic arm 30 also rotates about a vertical axis. A stepper motor 80 mounted to the plate 70 is effective to rotate in precise angular movements and thereby move the belt 78 and the pulley 76. A pulley 82 mounted to the shaft of the stepper motor 80 may be equipped with teeth, as does the pulley 76 and the belt 78. The stepper motor 80 is of the type that can be driven by a precise number of electrical pulses to rotate the pulley 82 through a corresponding precise angular movement.

The rotatable tube 74 is mounted to a U-shaped bracket 84, such as by welding. Mounted to the U-shaped bracket 84 is a first stepper motor 86 and a second stepper motor 88. The stepper motor 86 has a shaft 90 that is bolted, welded or otherwise fixed to a side member 92 of the reticulating arm 34. The arm 34 also has an opposing side member 94. Thus, with the stepper motor 86 rigidly fastened to the U-shaped member 84, and the shaft of the motor 86 fastened to the side member 92, when the motor is activated, the reticulating arm 34 is caused to rotate about the horizontal axis 36. While not shown, the shaft of the motor 86 protrudes through an opening in the U-shaped member 84. The second reticulating arm 38 includes opposed side members 96 and 98. The side members of the second reticulating arm 38 are mounted for pivotal movement about a horizontal axle 100. The axle 100 is either fixed or mounted for movement in the side arms 92 and 94 of the first arm 34. A pulley 102 is fixed, such as by welding, to the side arm 98 of the second reticulating arm 38.

The stepper motor 88 is mounted to the U-shaped bracket 84 in the same manner as the stepper motor 86. The shaft of the stepper motor 88 freely protrudes through a hole in the bracket 84, as well as a hole in the side member 94. Alternatively, the shaft of the motor 88 can be supported through a bearing in the side arm 94. Mounted to the shaft of the motor 88 is a toothed pulley 104, which pulley is coupled by way of a toothed belt 106 to the pulley 102. Hence, when the stepper motor 88 is caused to rotate by pulsing thereof, the belt 106 causes the fixed pulley 102 to rotate, thereby pivoting the second reticulating arm 38.

It should be noted that the first and second reticulating arms 34 and 38 cannot be pivoted through more than 360°, as they are limited by the brackets and other hardware. However, the processor and support circuits that generate the pulses can maintain an account of the number of pulses generated, and thus the precise angular orientation of the arm members. When predefined limits of angular orientation have been achieved by the reticulating arms 34 and 38, the processor can be prevented from generating further pulses, even though demanded by the joy stick controls 18 and 20. The rotational movement about the vertical axis of the robotic arm 30 is generally not limited, except by the wire cables and conductors that are routed through the tube 74 to provide pulses to the motors 86 and 88, as well as to the grabber actuator, to be described more fully below. It should also be noted that for aesthetic purposes, the motors 86 and 88 can be covered with decorative covers, as can be the reticulating arms 34 and 38. Rather than pivoting the robotic arm 30 in the manner shown, those skilled in the art may prefer to utilize ball and socket type joints that can be controlled as to unidirectional angular movements.

Mounted at the terminal end of the reticulating arm 38 is the fingered grabber 50. While the invention is described in connection with a specific type of grabber mechanism 50, other mechanisms, such as jaws, claws and enclosures can be utilized with suitable effectiveness. The fingers 52 of the grabber 50 are moved by a linear actuator 54. The linear actuator 54 is of Model K92111-P2-S1, obtainable from Philips Technology, P.O. Box 751397, Charlotte, N.C. 28275. The linear actuator 54 is mounted to a bracket 110 having ears 112 through which an axle rod 114 passes. The axle rod 114 is suitably fixed to the opposed ends of the second reticulating arm 38. With this construction, the linear actuator 54 freely hangs down from the end of the arm 38 under the influence of gravity. The linear actuator 54 has a plunger 116 that moves incrementally inwardly or outwardly with respect to the actuator 54, in response to electrical pulses supplied thereto. With the type of linear actuator identified above, the stem 116 can move one ten-thousandth inch for each pulse applied thereto. Accordingly, very accurate linear movements of the stem 116 can be obtained.

A grabber anchor bracket 120 is clamped around the linear actuator 154 to fasten the parts together. The anchor bracket 120 includes three hinge points, one shown as reference character 122. The hinge points are provided for pinning thereto a forked part 124 of the fingers 52. Because the preferred embodiment of the invention utilizes three grabber fingers, three corresponding attachment points 122 are provided. Those skilled in the art may desire to utilize fewer or more fingers 52, and configure the shape of the fingers differently for grasping different types of physical objects or prizes. Fastened to the end of the linear actuator stem 116 is a plate 126, also having three projections with a ball 128 at the respective ends thereof. Each ball 128 is captured within a respective socket 130 of an internally threaded tube 132. A connecting link 134 is pivotally pinned with a pin 135 within a second hole of the forked part 124 of the finger 52, while an externally threaded end thereof is threaded into the socketed part 130. With this arrangement, by rotating the socket part 128 with respect to its threaded engagement with the connecting link 134, the position of each finger 52 can be adjusted with respect to the other fingers. The double-hinged arrangement of the fingers 52 provides a mechanical lever advantage and allows the grabber 50 to be closed when the actuator stem 116 is fully extended, and to be fully opened when the stem 116 is linearly retracted within the actuator 54. By incrementally moving the actuator stem 116 under control of pulses applied to the actuator 54, precise positioning of the fingers 52 can be obtained. The open position of the fingers is shown in broken line in FIG. 2. Further, because of the double hinged arrangement of the fingers 52, very small movements of the actuator stem 116 cause correspondingly amplified movements of the respective fingers 52.

Movement of the joy stick 20 to the left is sensed by the processor, which then causes the generation of pulses to be applied to the linear actuator 54 to extend the stem 16 outwardly, thus closing the grabber fingers 52. On the other hand, when the joy stick 20 is moved to the right by the player, pulses are generated to retract the stem 116, thereby opening the grabber fingers 52. It can be appreciated that a substantial degree of skill and/or coordination is required by the player of the amusement machine in order to succeed in grabbing a prize.

Figure 4:
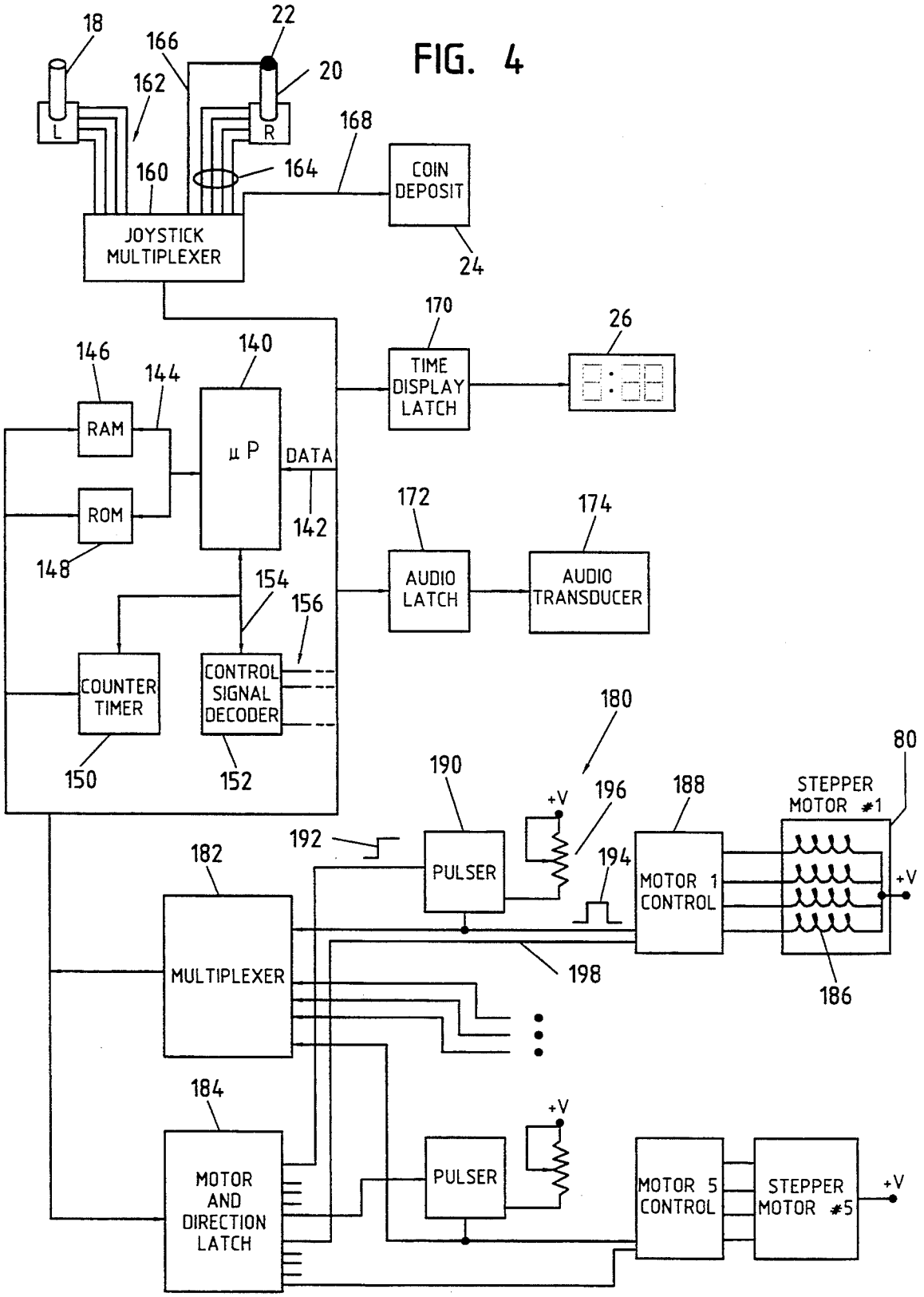
FIG. 4 is a block diagram illustrating the functional circuits for controlling the robotic arm and grabber.

Reference is now made to FIG. 4 where there is illustrated a block diagram of the basic functions of the processor controlled circuits. A microprocessor 140 is programmed to carry out various functions of the robotic amusement machine of the invention, described in more detail below. The microprocessor 140 includes a data bus 142 and an address bus 144 coupled to the various circuits for control thereof. The data and address buses 142 and 144 are connected to of random access memory 146 and read only memory 148. The ROM 148 stores the program instructions carried out by the microprocessor 140 while the RAM 146 provides the temporary memory for storing data and other parameters generated by the microprocessor 140 while carrying out the programmed instructions. In the preferred embodiment of the invention, the microprocessor 140 is of the Z80 type having a 16-bit address bus 144 and an 8-bit data bus 142. The microprocessor 140 is coupled to a Z80CTC counter/timer 150 that functions as a timer for providing real-time interrupts to the microprocessor 140. In other words, the counter/timer 150 is programmed to interrupt the microprocessor 140 at periodic time periods to establish a time base. A control signal decoder 152 is coupled by a read, write, IORQ, MREQ and M1 bus 154 to the microprocessor 140, as is the counter/timer 150. The decoder 152 decodes such signals and provides individual output control signals 156 for enabling the other circuits controlled by the microprocessor 140, as shown in FIG. 4.

The microprocessor data bus 142 is coupled to a joy stick multiplexer 160 for providing joy stick position data to the microprocessor 140. For example, the left joy stick 18 is coupled by four conductors 162 to the multiplexer 160. The conductors 162 couple respective left, right, forward and backward signals to the multiplexer 160, depending upon the position of the joy stick 18. As is conventional with such type of joy stick controls 18, both a forward and right signal can be coupled to the multiplexer 160, if the joy stick 18 is pushed by the player to the upper right corner of the control 18. Other combinations of signals indicating the position of the joy stick 18 can be coupled to the multiplexer 160. The right joy stick 20 is similarly coupled to the multiplexer 160 by four conductors 164, and an additional conductor 166 that carries signals corresponding to the depression of the joy stick start button 22. A coin deposit mechanism 44 is correspondingly coupled to an input of the multiplexer 160 by conductor 168 to provide signals indicating the amount of money or coins deposited in the robotic amusement machine. The microprocessor 140 is programmed to periodically poll each input of the joy stick multiplexer 160 and determine the status of each conductor thereof, and thereby determine the position of the joy sticks 18 and 20, as well as the electrical status of the push button 122 and the coin deposit mechanism 24. One or more control signals from the decoder 152 is coupled to the joy stick multiplexer 160 for enabling the circuit, as well as for selecting which input thereof is to be coupled to the data bus 142.

The microprocessor data bus 142 is coupled to a time display latch 170 for latching data therein for driving a digital display 26. While a 3-digit display 26 is illustrated, additional digits may be utilized. As noted above, the time display 26 is mounted to the front panel 16 of the amusement machine for providing the player with either the time that has elapsed during the activation of the start button 22, or the time is remaining after activation of the switch 22. The time display latch 170 comprises a number of O-type latches for storing the digit information for each segment of the display 26. The counter/timer 150 provides the time base for interrupting the microprocessor 140, whereby the time display latch 170 is updated each second, or so, to thereby update the segments of the display 26. The player is thus made aware of the time of play remaining in which to succeed in obtaining a prize with the robotic arm 30.

An audio circuit latch 172 is also coupled to the microprocessor data bus 142 for receiving digital information that is converted into audio sounds by an audio transducer 174. The audio transducer 174 may comprise digital-to-analog converters and other suitable speaker equipment for converting the digital signals into audio sounds. The microprocessor 140 can be programmed to produce audio sounds during an attract mode for attracting players to the machine. Further, the microprocessor 140 can be programmed to generate audio instructions for enabling a player to understand the procedures for operating the robotic amusement machine. Other audio sounds can be generated during the play to further provide the player with various sounds to complement and generate excitement during playing of the machine.

Motor control circuits 180 are shown in FIG. 4 coupled to the microprocessor data bus 142. The motor control circuits 180 include a multiplexer 182 for providing the microprocessor 140 a count of the number of pulses that have been generated for pulsing either the stepper motors and/or the linear actuator 154. A motor and direction latch 184 latches signals from the microprocessor data bus 142 to provide corresponding signals that actuate the stepped motors, as well as the direction of movement thereof. As noted above, the present invention contemplates four stepper motors and one linear actuator, all of which are driven by the same circuits shown in FIG. 4. Thus, while the motor circuits are generally the same, the drive circuit for stepper motor 80 will be described, it being realized that the operation of the other drive circuits is substantially identical. The multiplexer 182 and the motor and direction latches 184 are enabled by signals generated by the control signal decoder 152. The stepper motor 80 was described above as controlling the rotational movement of the robotic arm 30. The stepper motor 80 includes four windings, one of which is shown by reference character 186. The motor control integrated circuit 188 is of an SAA1027 type, that produces respective digital signals on the four outputs thereof for driving the corresponding stepper motor windings 186. Depending upon the particular stepper motors utilized, additional driver circuits on the output of the motor control circuit 188 may be required. Those skilled in the art can readily appreciate the manner in which the stepper motors are controlled by such type of motor control chip 188.

An LM555 timer 190 is configured as an astable multivibrator for generating pulses and driving the motor control circuit 188. For each enabling signal 192 provided to an input of the pulser 190, output pulses 194 are produced and coupled to the motor control circuit 188 for so long as the enabling signal 192 is active. In other words, the pulser 190 is configured to provide output pulses of a predefined pulse width and period when an enabling pulse 192 is coupled to an input thereof. The period of the out pulses 194 can be controlled by a potentiometer 196. The potentiometer 196 is available to the owner of the amusement machine of the invention for controlling the speed of the various motors. Those skilled in the art may find it desirable to program the microprocessor 140 to respond to input selections by a player to achieve a high, medium or low speed operation of the various motors. In this event, the repetition rate of the pulses 194 generated by the pulser 190 would be controlled by the microprocessor 140, rather than the owner of the machine.

The enabling signal 192 is generated by the microprocessor 140 and stored by the motor and direction latch 184. The latch 184 provides either a logic low or logic high signal on conductor 198 for allowing the motor control circuit 188 to cause the stepper motor 80 to rotate in either a clockwise or counterclockwise direction. The linear actuator 54 does not rotate, but rather is stepped in a manner so as to either extend or retract the actuator shaft 116 (FIG. 2). The microprocessor 140 couples signals via the data bus 142 to the motor and direction latch 184 for providing enabling and directional signals to each of the motor control circuits 188. It should be realized that the various stepper motors and actuators of the amusement machine can be simultaneously activated for causing corresponding movements of the associated apparatus.

Each pulse 194 generated by the pulser 190 is coupled to the motor control circuit 188, as well as to an input of the multiplexer 182. An indication of the generation of each pulse 194 is therefore coupled by the multiplexer 182 and the data bus 142 to the microprocessor 140. The microprocessor 140 has available information concerning the precise and instantaneous position of each motor or actuator, and thus the position of the movable elements of the amusement machine of the invention. The determination of the precise position of the various movable parts is desired in order to return the mechanisms to a home position after termination of play. In addition, the microprocessor 140 is programmed so as not to allow movements of the various parts of the robotic arm beyond predefined positions to thereby guard against damage thereto. For example, the robotic arm 30 is controlled by the microprocessor 140 so as not to rotate in one direction more than about 4–5 revolutions, and thereby prevent damage to the wire conductors that rotate with the robotic arm 30.

With the structure described above, those skilled in the art can readily devise software for controlling the robotic arm to carry out the functions and movements described. While the preferred embodiment of the invention has been disclosed with reference to specific structures and methods of operation, it is to be understood that many changes in detail may be made as a matter of engineering choices, without departing from the spirit and scope of the invention, as defined by the appended claims.

What is claimed is:

1. In a player-controlled game machine, a method of controlling a grabber for obtaining a prize, comprising the steps of:

providing a robotic arm;

providing a grabber with movable members, mounted to an end of the robotic arm;

providing player controls for moving the robotic arm about plural axes of pivotal movement so that the grabber can be spatially positioned with respect to a prize; and providing electrical apparatus for incrementally opening and closing the movable members of the grabber so that the movable members of the grabber can be moved and remain in a plurality of positions between a fully open and a fully closed position to secure the prize.

2. The method of claim 1, further including providing rotational movements of the robotic arm about a vertical axis, and providing pivotal movement of reticulated parts of the robotic arm about at least two horizontal axes.

3. The method of claim 1, further including providing a pair of joy sticks, a first of the joy sticks movable in one direction for rotating a first part of the robotic arm about a vertical axis and movable in another direction for moving the robotic arm and thus the grabber in a vertical direction, a second of the joy sticks being movable in one direction to open and close the grabber, and movable in another direction for moving a second part of the robotic arm in a vertical direction.

4. The method of claim 1, further including opening and closing the grabber members by actuating a linear actuator to a plurality of intermediate linear positions and by way of hingable linkage opening and closing the members of the grabber.

5. The method of claim 4, further including actuating the linear actuator by pulsing the linear actuator with electrical pulses and incrementally moving an actuator stem, thereby moving the linkage of the grabber.

6. The method of claim 1, further including enclosing the robotic arm and prize with an enclosure, and providing an openable door in the enclosure, and controlling the grabber to open the door for grabbing a prize in the container with the grabber, and delivering the prize with the grabber through the opening.

7. The method of claim 1, further including enabling actuation of the robotic arm by detecting a deposit of money in the game machine.

8. The method of claim 7, further including controlling an amount of time the robotic arm is actuated corresponding to an amount of money deposited in the game machine.

9. The method of claim 8, further including maintaining an account of successful attempts in grabbing a prize and delivering the prize to a player, and comparing a number of successful attempts and failures according to a predefined schedule, and reducing the play time a specified amount if the number of successes exceeds the predefined schedule.

10. The method of claim 7, further including maintaining the robotic arm actuated until a prize is grabbed and delivered to a player.

11. The method of claim 1, further including providing different degrees of speed by which the robotic arm can be moved.

12. The method of claim 1, further including moving the robotic arm under control of a processor independently of a player to attract players to the game machine.

13. In a player-controlled game machine, a method of controlling a grabber for obtaining a prize, comprising the steps of:

detecting a deposit of money in the game machine;

in response to the detection of the deposit of money, allowing movement of a first joy stick in plural directions to move a robotic arm in corresponding plural directions;

in response to the detection of the deposit of money, allowing movement of a second joy stick in one direction to move the robotic arm with one degree of freedom, and moving the second joy stick in another direction to control opening and closing of the grabber; and in response to actuation of a start button by a player of the game machine, responding to movements of the first and second joy sticks only for a predefined period of time.

14. The method of claim 13, further including moving one said joystick in one direction to incrementally move members of the grabber to a closed position, and moving said one joystick another direction to incrementally move the grabber members apart, whereby the grabber members can be incrementally moved and maintained between opened and closed positions.

15. The method of claim 14, further including moving a linear actuator in response to movements of said one joystick to incrementally move a linear actuator shaft, thereby moving the grabber members.

16. A player-controlled game machine, comprising:

an articulated robotic arm;

a plurality of motors, each for moving a portion of the articulated robotic arm so that an end of the robotic arm can be oriented in a plurality of spatial locations;

a first control operated by a player of the game machine, said first control being operative to control the motors and thereby control the spatial location of the end of the robotic arm;

a grabber attached to the end of the robotic arm, said grabber having members that are movable between an open and a closed position;

an electrical actuator mechanically coupled to the grabber for moving the grabber members between the open and closed positions and a plurality of positions therebetween;

a second control operated by the player of the game machine, said second control being operative to control movement of the electrical actuator and maintain the position of the grabber members between any of said plurality of said open and closed positions; and an enclosure for housing prizes and for containing the robotic arm so that a player can control the spatial location of the grabber and obtain a prize.

17. The player-controlled game machine of claim 16, wherein said electrical actuator comprises a linear actuator for linearly moving a shaft in increments in response to movement of said second control.

18. The player-controlled game machine of claim 17, wherein said grabber includes a plurality of finger members hinged so as to open and close toward each other, and said shaft of said linear actuator is connected to a common point of said plurality of finger members so that movement of the shaft is translated through hinged connections to movement of the finger members.

19. In a player-controlled game machine, a method of controlling a grabber for obtaining a prize, comprising the steps of:

providing an articulated robotic arm;

providing electrical motors for moving articulated parts of the robotic arm;

providing a grabber with movable members attached to an end of the robotic arm;

providing a first player control for moving the end of the robotic arm to plural spatial positions;

providing a second player control for moving the movable members of the grabber;

providing a program-controlled processor for driving the electrical motors to move the articulated parts of the robotic arm; and providing a software program including instructions for an attract mode for controlling the processor to move the articulated parts of the robotic arm without movement of the first or second player controls to attract players to the game machine.

20. The method of claim 19, further including moving the grabber movable members during running of the attract mode software by the processor.

* * * * *